US007330673B2

(12) United States Patent
Eom

(10) Patent No.: US 7,330,673 B2
(45) Date of Patent: Feb. 12, 2008

(54) IMAGE FORMING DEVICE, CONSUMABLE USED IN THE IMAGE FORMING DEVICE, AND METHOD OF MANAGING STATUS INFORMATION OF THE CONSUMABLE

(75) Inventor: Yoon-Seop Eom, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 269 days.

(21) Appl. No.: 11/039,858

(22) Filed: Jan. 24, 2005

(65) Prior Publication Data

US 2005/0163516 A1 Jul. 28, 2005

(30) Foreign Application Priority Data

Jan. 24, 2004 (KR) ..... 10-2004-0004564

(51) Int. Cl.
*G03G 15/00* (2006.01)

(52) U.S. Cl. ..... 399/24; 399/12; 399/27

(58) Field of Classification Search ..... 399/12, 399/24, 27, 29

See application file for complete search history.

(56) References Cited

U.S. PATENT DOCUMENTS 4,933,718 A * 6/1990 Furuya ..... 399/13
5,335,048 A * 8/1994 Takano et al. ..... 399/8
5,699,091 A * 12/1997 Bullock et al. ..... 347/19
5,930,553 A * 7/1999 Hirst et al. ..... 399/8
6,863,364 B2 * 3/2005 Russell et al. ..... 347/19
7,009,719 B2 * 3/2006 Willis et al. ..... 358/1.1
7,043,166 B2 * 5/2006 Parry et al. ..... 399/12
2002/0131784 A1 * 9/2002 Takemoto ..... 399/12
2003/0227501 A1 * 12/2003 Hatasa et al. ..... 347/19

FOREIGN PATENT DOCUMENTS

KR 2003-0004351 1/2003

* cited by examiner

*Primary Examiner*—Anjan Deb
(74) *Attorney, Agent, or Firm*—Roylance, Abrams, Berdo & Goodman, LLP

(57) ABSTRACT

A device for and method of managing status information on a consumable for an image forming device by using memory included in the consumable is provided. The image forming device having more than one consumables and transferring an electrostatic image formed on a surface of a photosensitive medium onto paper comprises an image forming unit printing a predetermined image in response to a control of a central controller, and a management memory storing management information related to status information of the consumables. The central controller reads the consumable information including remaining lifetime of the consumable from a consumable memory including in the consumable, reads the management information from the management memory included in the image forming device, calculates an amount of use of the consumables during an operation of the image forming device, and updates the consumable information and the management information using the calculated amount of use.

16 Claims, 8 Drawing Sheets

FIG. 9A

| | | | 07 | 06 | 05 | 04 | 03 | 02 | 01 | 00 |
|---|---|---|---|---|---|---|---|---|---|---|
| 0 | Yellow cartridge | 0x00 | S | A | M | S | U | n | G | y |
| 1 | Model Name | 0x05 | C | O | L | O | R | 1 | 0 | 0 |
| 2 | MFG Date | 0x10 | 2 | 0 | 0 | 3 | 1 | 0 | 0 | 1 |
| 3 | Serial Number | 0x18 | S | n | 0 | 0 | 0 | 0 | 0 | 1 |
| 4 | Printing pages count | 0x20 | 0 | 0 | 0 | 0 | 0 | 0 | 0 | 0 |
| 5 | Toner Capacity | 0x28 | 0 | 0 | 0 | 0 | 1 | 0 | 0 | 0 |
| 6 | Printing pages count | 0x30 | 0 | 0 | 0 | 0 | 0 | 0 | 0 | 0 |
| 7 | Magenta Cartridge | 0x38 | S | A | M | S | U | n | G | m |
| 8 | Model Name | 0x40 | C | O | L | O | R | 1 | 0 | 0 |
| 9 | MFG Date | 0x48 | 2 | 0 | 0 | 3 | 1 | 0 | 0 | 1 |
| 10 | Serial Number | 0x50 | S | n | 0 | 0 | 0 | 0 | 0 | 1 |
| 11 | Printing pages count | 0x58 | 0 | 0 | 0 | 0 | 0 | 0 | 0 | 0 |
| 12 | Toner Capacity | 0x60 | 0 | 0 | 0 | 0 | 0 | 0 | 0 | 0 |
| 13 | Printing dot count | 0x68 | 0 | 0 | 0 | 0 | 0 | 0 | 0 | 0 |
| 14 | Cyan Cartridge | 0x70 | S | A | M | S | U | n | G | c |
| 15 | Model Name | 0x78 | C | O | L | O | R | 1 | 0 | 0 |
| 16 | MFG Date | 0x80 | 2 | 0 | 0 | 3 | 1 | 0 | 0 | 1 |
| 17 | Serial Number | 0x88 | S | n | 0 | 0 | 0 | 0 | 0 | 1 |
| 18 | Printing pages count | 0x90 | 0 | 0 | 0 | 0 | 0 | 0 | 0 | 0 |
| 19 | Toner Capacity | 0x98 | 0 | 0 | 0 | 0 | 1 | 0 | 0 | 0 |
| 20 | Printing dot count | 0xA0 | 0 | 0 | 0 | 0 | 0 | 0 | 0 | 0 |
| 21 | Black Cartridge | 0xA8 | S | A | M | S | U | n | G | k |
| 22 | Model Name | 0xB0 | C | O | L | O | R | 1 | 0 | 0 |
| 23 | MFG Date | 0xB8 | 2 | 0 | 0 | 3 | 1 | 0 | 0 | 1 |
| 24 | Serial Number | 0xC0 | S | n | 0 | 0 | 0 | 0 | 0 | 1 |
| 25 | Printing pages count | 0xC8 | 0 | 0 | 0 | 0 | 0 | 0 | 0 | 0 |
| 26 | Toner Capacity | 0xD0 | 0 | 0 | 0 | 0 | 1 | 0 | 0 | 0 |
| 27 | Printing pages count | 0xD8 | 0 | 0 | 0 | 0 | 0 | 0 | 0 | 0 |
| 28 | Image Transfer unit | 0xE0 | S | A | M | S | U | n | G | I |
| 29 | Model Name | 0xE8 | C | O | L | O | R | 1 | 0 | 0 |
| 30 | MFG Date | 0xF0 | 2 | 0 | 0 | 3 | 1 | 0 | 0 | 1 |
| 31 | Serial Number | 0xF8 | S | n | 0 | 0 | 0 | 0 | 0 | 1 |
| 32 | Printing pages count | 0x100 | 0 | 0 | 0 | 0 | 0 | 0 | 0 | 0 |
| 33 | Reserved | 0x108 | | | | | | | | |
| 34 | Reserved | 0x110 | | | | | | | | |
| 35 | OPC unit | 0x118 | S | A | M | S | U | n | G | o |
| 36 | Model Name | 0x120 | C | O | L | O | R | 1 | 0 | 0 |
| 37 | MFG Date | 0x128 | 2 | 0 | 0 | 3 | 1 | 0 | 0 | 1 |
| 38 | Serial Number | 0x130 | S | n | 0 | 0 | 0 | 0 | 0 | 1 |
| 39 | Printing pages count | 0x138 | 0 | 0 | 0 | 0 | 0 | 0 | 0 | 0 |

FIG. 9B

| | | | 07 | 06 | 05 | 04 | 03 | 02 | 01 | 00 |
|---|---|---|---|---|---|---|---|---|---|---|
| 0 | Supplier(10), Color | 0x00 | S | A | M | S | U | n | G | y |
| 1 | Model Name | 0x05 | C | O | L | O | R | 1 | 0 | 0 |
| 2 | MFG Date | 0x10 | 2 | 0 | 0 | 3 | 1 | 0 | 0 | 1 |
| 3 | Serial Number | 0x18 | S | n | 0 | 0 | 0 | 0 | 0 | 1 |
| 4 | Printing pages count | 0x20 | 0 | 0 | 0 | 0 | 0 | 0 | 0 | 0 |
| 5 | Toner Capacity | 0x28 | 0 | 0 | 0 | 0 | 1 | 0 | 0 | 0 |
| 6 | Printing pages count | 0x30 | 0 | 0 | 0 | 0 | 0 | 0 | 0 | 0 |

IMAGE FORMING DEVICE, CONSUMABLE USED IN THE IMAGE FORMING DEVICE, AND METHOD OF MANAGING STATUS INFORMATION OF THE CONSUMABLE

BACKGROUND OF THE INVENTION

This application claims the benefit under 35 U.S.C. §119 (a) of Korean Patent Application No. 2004-4564, filed on Jan. 24, 2004, in the Korean Intellectual Property Office, the entire disclosure of which is hereby incorporated by reference.

1. Field of the Invention

The present invention relates to an image forming device. More particularly, the present invention relates to a device and method for managing status information related to a consumable for an image forming device by using memory included in the consumable.

2. Description of the Related Art

Generally, a photocopy-type image forming device generates an electrostatic image on a photosensitive medium such as a photosensitive drum or a photosensitive belt, and develops the electrostatic image by transferring toner of a predetermined color onto paper.

FIG. 1 schematically shows a conventional image forming device 100.

The conventional image forming device 100 comprises a developing unit 110, a transferring unit 160, and a fixing unit 150. To generate a predetermined image, the developing unit 110 supplies toner to an electrostatic image formed on a photosensitive medium 115 by a laser scanning unit 180. The developing unit 110 comprises a developing roller 170 installed to be partially soaked into toner in a toner container 175 and to rotate with respect to the photosensitive medium 115. The transferring unit 160 is installed to be located on a side of paper with respect to the photosensitive medium 115 and transfers the image formed on the photosensitive medium 115 onto the paper. The fixing unit 150 presses the image transferred onto the paper by the transferring unit 160 by heat and/or pressure. The transferring unit 160 can also perform the fixing operation when connected to a predetermined heat source.

Additionally, the image forming device 100 comprises a paper cassette 130, a roller 135, which picks up paper from the cassette and supplies the paper to a path adjacent to the transferring unit and the photosensitive medium. The image forming device 110 further comprises a paper ejector 190, which ejects paper on which an image is formed and fixed.

Consumables used in the conventional image forming device comprise four toner cartridges (Yellow, Magenta, Cyan, Black), a middle transferring belt, and a photosensitive drum. Each of the consumables is identified by using an identification KEY resistor. It is impossible to identify the remaining lifetime of a toner cartridge when no sensor is provided. The following operations are used to estimate the remaining lifetime of consumables.

At first, lifetime data is initialized in a first non-volatile memory included in the image forming device when a consumable is replaced. Then, a printout number count is stored in the first non-volatile memory and the amount of consumable use is calculated by adding dot numbers of the image data.

In the case of the middle transferring belt and the photosensitive drum, the amount of consumable use is calculated by using image printout numbers, which is based on value stored in the printout counter. Usually, the middle transferring belt and the photosensitive drum can print more than 50,000 sheets of paper, and the printout counter can be cleared after replacing the toner cartridge. Alternatively, a user can directly manipulate the counter to clear it.

FIG. 2 illustrates a conventional consumable included in an image forming device.

As noted above, the consumable can either be a toner cartridge, a middle transferring belt, or a photosensitive drum. The consumable includes identification information and provides it to the image forming device.

FIG. 3 schematically shows a conventional consumable in conventional image forming device.

The consumable 200 in FIG. 3 is identified by key resistors R1 and R2. The image forming device 100 uses a detection driver 105 to detect the consumable 200, and stores the status information of the consumable in a memory 109. Preferably, an ASIC 105 acts as a central controller.

In the image forming device 100 in FIG. 3, a KEY detection signal is differentiated based on the resistors R1 and R2. That is, when the image forming device 100 divides a pull-up resistor and the key resistor R2 of the consumable 200, a different voltage is sensed based on the resistance of the key resistor R2.

FIG. 4 illustrates a KEY detection signal of a consumable 200 included in a conventional image forming device 100.

In FIG. 4, the X axis denotes an output voltage and the Y axis denotes a resistance R2. In this particular example, the resistance of the pull-up resistor can be equal to 47 Kohm and Vcc is equal to 3.3V. As shown in FIG. 4, the output voltage is differentiated based on the resistance R2, which identifies the KEY detection signal.

FIG. 5 is a flowchart of a conventional management method of a consumable in an image forming device.

The method in FIG. 5 includes detecting an installation status and determining whether the expected lifetime is exceeded. Further, the remaining lifetime is calculated when the lifetime is not exceeded.

However, the conventional management method is subject to noise due to analog voltages since there are a plurality of consumables included in the image forming device. Noise interference can result in misreading of the status information. Furthermore, since the reading error is not negligible since the amount of the consumable used is calculated using dot numbers of image data in a software program, it is nearly impossible to estimate the remaining lifetime when a second-hand consumable is installed. Also, the remaining lifetime cannot be estimated when the memory included on the image forming device is erased due to a replacement of a mainboard.

Therefore, reliable methods and devices for easily managing status information of a plurality of consumables are needed.

SUMMARY OF THE INVENTION

It is an object of the present invention to provide a method for stably managing status information regarding consumables included in an image forming device.

It is another object of the present invention to provide an image forming device which stably manages status information of consumables used therein.

It is still another object of the present invention to provide a consumable used in the image forming device, the consumable including a memory safely storing status information thereon.

According to an aspect of the present invention, there is a method of managing the status of a consumable in an image forming device for transferring an electrostatic image formed on a surface of a photosensitive medium onto paper. The method comprising the steps of reading consumable information including the remaining lifetime from a consumable memory in the consumable; reading management information related to status of more than one consumables in the image forming device from a management memory in the image forming device; calculating an amount of use of the consumables during an operation of the image forming device; and updating the consumable information and the management information based on the calculated amount of use. The method preferably comprises comparing the read consumable information with the management information; and updating the consumable information using the management information when the consumable information and the management information are identical. The method preferably comprises the steps of determining whether the consumable is newly installed in the image forming device by using the information about the manufacturer and the unique identifier; and initializing the management information and informing a user of the newly installed consumable when the consumable is determined to be a newly installed one, and wherein the consumable information and the management information further includes information about a manufacturer of the consumable and a unique identifier of the consumable. The method preferably comprises analyzing the consumable information read from the consumable memory, and informing the user that the consumable is not installed safely when the commodity information is determined not to be valid.

According to another aspect of the present invention, there is provided an image forming device having more than one consumable and transferring an electrostatic image formed on a surface of a photosensitive medium onto paper, the device comprising an image forming unit for printing a predetermined image in response to a control of a central controller; and a management memory for storing management information related to status information of the consumables, and the central controller that reads the consumable information including the remaining lifetime of the consumable from a consumable memory in the consumable; reads the management information from the management memory in the image forming device; calculates an amount of use of the consumables during an operation of the image forming device; and updates the consumable information and the management information using the calculated amount of use. The central controller preferably compares the read consumable information with the management information; and updates the consumable information using the management information when the consumable information and the management information are identical. The consumable information and the management information preferably include information about a manufacturer of the consumable and a unique identifier of the consumable, and the central controller further determines whether the consumable is newly installed in the image forming device by using the information about the manufacturer and the unique identifier; and initializes the management information and informs a user of the newly installed consumable when the consumable is determined to be a newly installed one. The central controller preferably analyzes the consumable information read from the consumable memory, and informs the user that the consumable is not installed safely when the commodity information is determined not to be valid. The consumable is either a middle transferring belt for transferring the electrostatic image or a photosensitive drum on which the electrostatic image is formed, and the central controller uses an operation time of the middle transferring belt and a number of rotations of the photosensitive drum to calculate the amount of use of the consumable.

According to the other aspect of the present invention, there is provided a consumable used in an image forming device, the consumable comprising a memory for storing consumable information related to a remaining lifetime of the consumable and providing the consumable information to the image forming device in response to a signal of the image forming device, and the consumable memory updates the consumable information as the consumable is being used in response to a control of the image forming device. The consumable information preferably includes information about a manufacturer of the consumable and a unique identifier of the consumable. The consumable is either a middle transferring belt for transferring an electrostatic image or a photosensitive drum on which the electrostatic image is formed. The consumable can be a toner cartridge containing toner of a predetermined color.

BRIEF DESCRIPTION OF THE DRAWINGS

The above and other features and advantages of the present invention will become more apparent by describing in detail exemplary embodiments thereof with reference to the attached drawings in which:

FIG. 9A and 9B illustrate status information of a consumable managed by the method according to an embodiment of the present invention.

Throughout the drawings, like reference numbers will be understood to refer to like elements, features and structures.

DETAILED DESCRIPTION OF THE EXEMPLARY EMBODIMENTS

Figure 1:
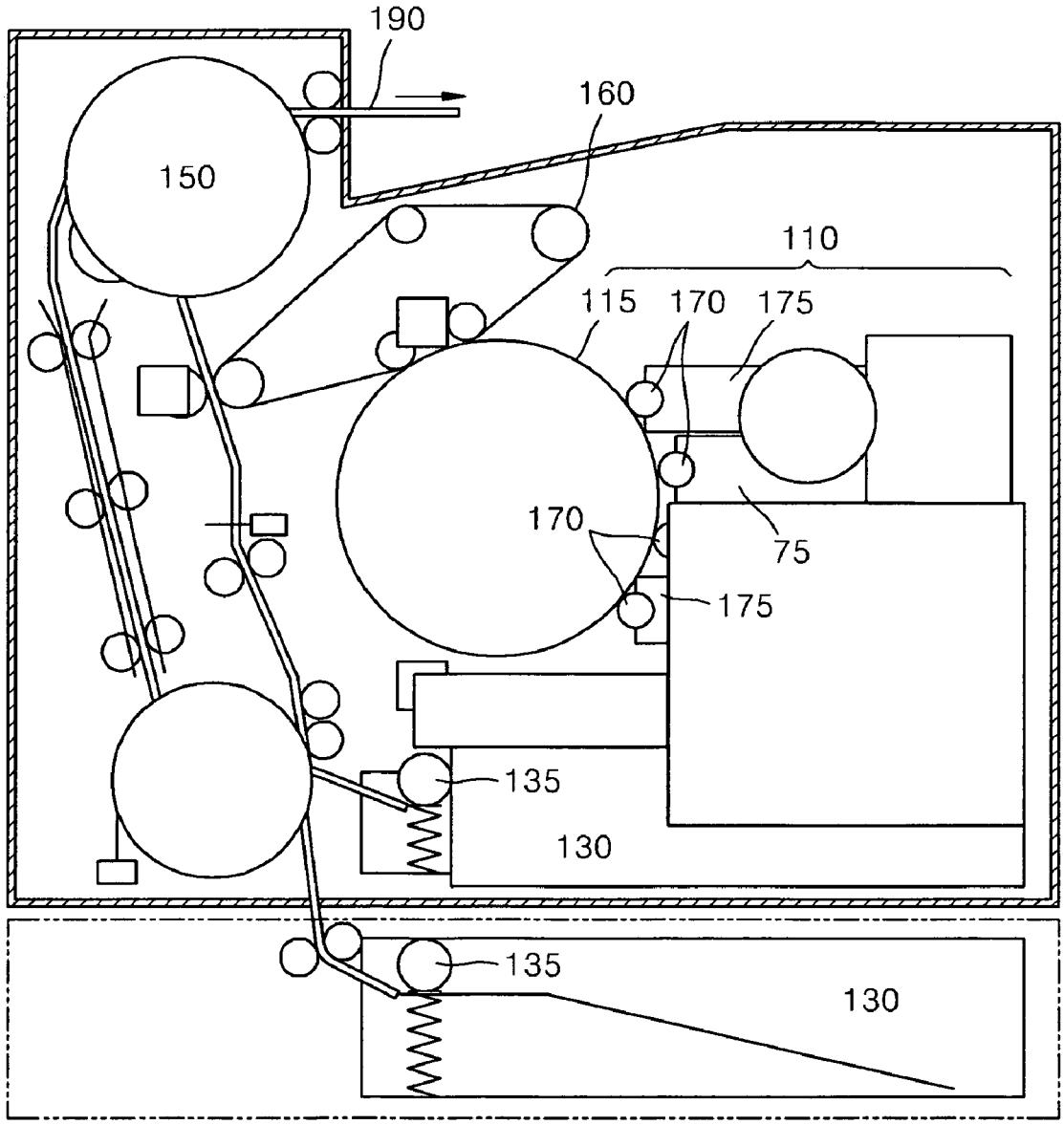
FIG. 1 (PRIOR ART)
FIG. 1 schematically shows a conventional image forming device.
Figure 2:
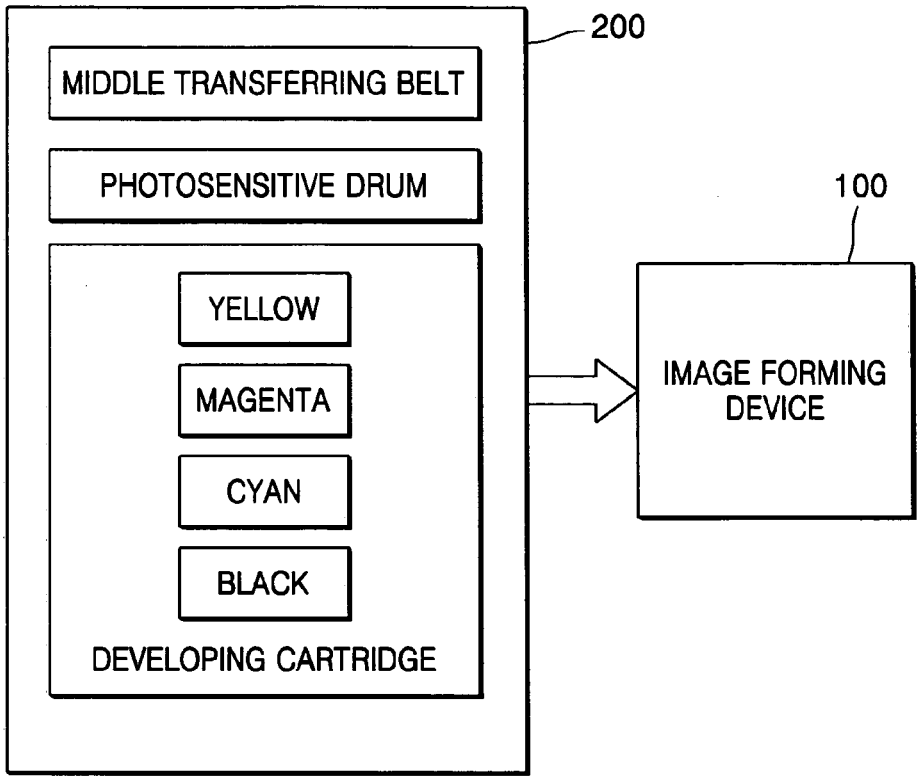
FIG. 2 (PRIOR ART)
FIG. 2 illustrates a conventional consumable in a conventional image forming device.
Figure 3:
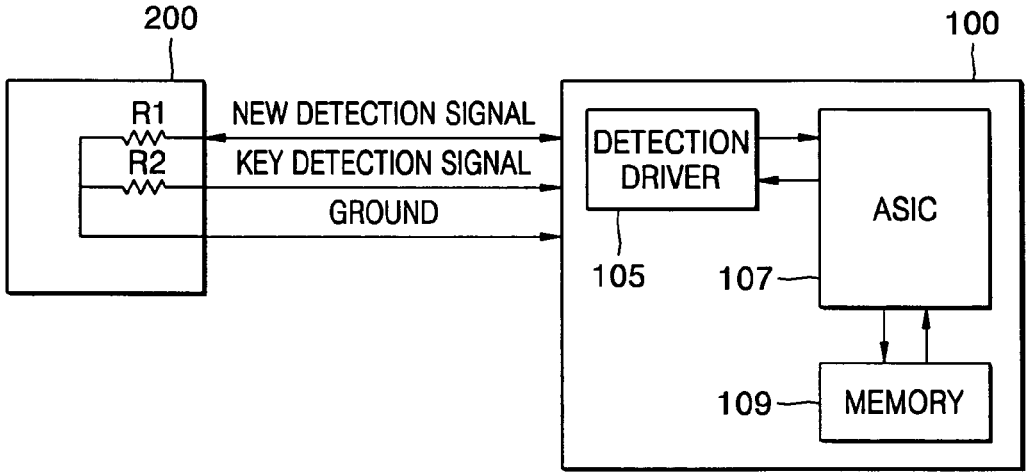
FIG. 3 (PRIOR ART)
FIG. 3 schematically shows a conventional consumable connected to an image forming device.
Figure 4:
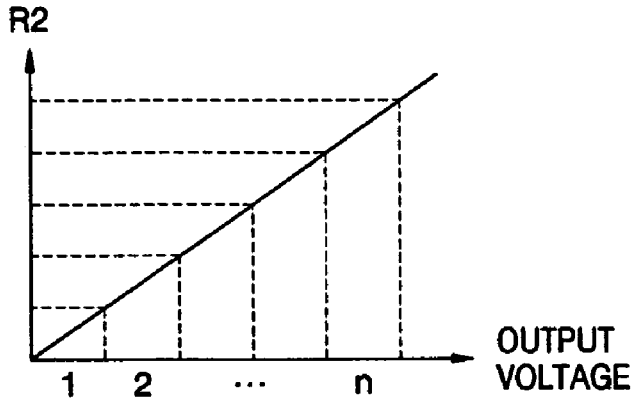
FIG. 4 illustrates a KEY detection signal of a consumable in a conventional image forming device.
Figure 5:
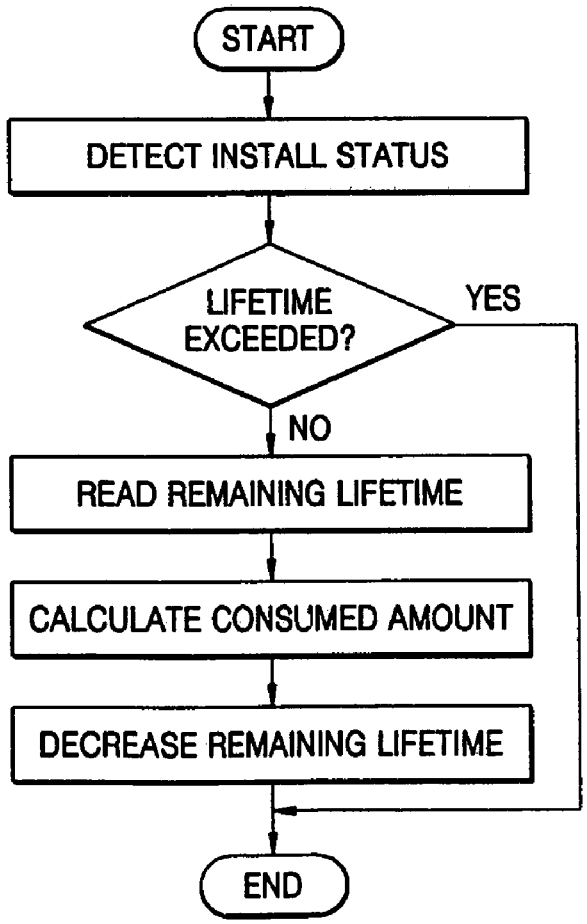
FIG. 5 is a flowchart of a conventional management method of a consumable in an image forming device.
Figure 6:
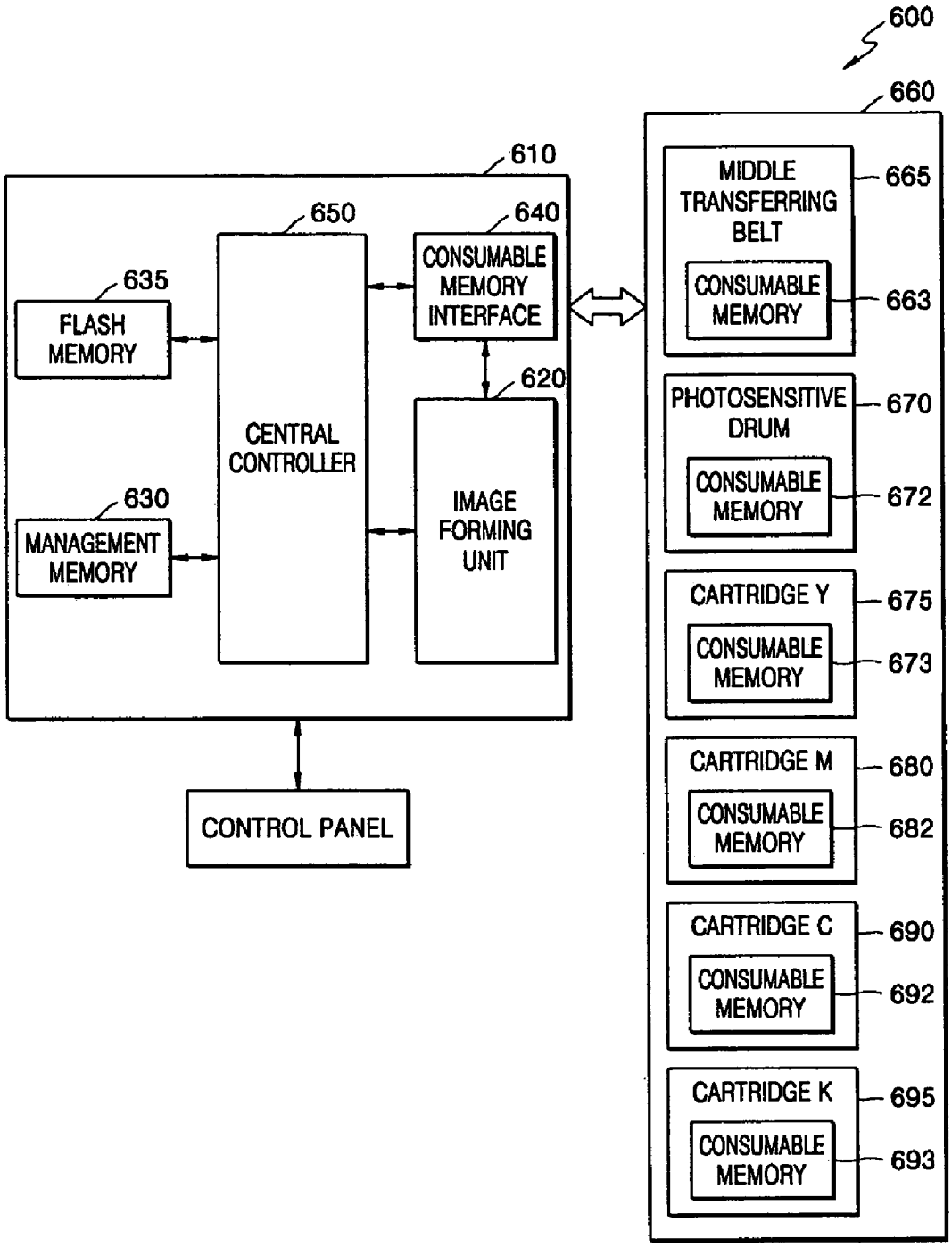
FIG. 6 is a block diagram of the image forming device according to an embodiment of the present invention.

FIG. 6 is a block diagram of an embodiment of the image forming device according to the present invention. The image forming device 600 comprises a main body 610 and consumables 660. The main body 610 includes a central controller 650, an image forming unit 620, a flash memory 635, a management memory 630, and a consumable memory interface 640. The consumables 660 include a middle transferring belt 665, a photosensitive drum 670, a Yellow cartridge (cartridge Y) 675, a Magenta cartridge (cartridge M) 680, a Cyan cartridge (cartridge C) 690, and a Black cartridge (cartridge K) 695. As shown in FIG. 6, the consumables included in the image forming device 600 respectively have consumable memories 663, 672, 673, 682, 692 and 693. A control panel is connected to the main body 610 to receive user inputs.

The central controller 650 controls the overall operation of the image forming device 600. At first, the central controller 650 uses the consumable memory interface 640 for transmitting and receiving data to and from the consumables 660 and determines whether the consumables are securely installed. For example, the central controller 650 receives status information from the consumable memory 663 included in the middle transferring belt 665. Then, the central controller 650 analyzes the status information and determines whether the middle transferring belt 665 is securely installed when the status information is valid.

Also, the central controller 650 compares the read status information with status information stored in the management memory 630 and determines that the read status information is not valid when two pieces of information are not identical. In this case, erroneous status information is restored using a valid one. For example, when the status information stored in the management memory 630 is not valid, the status information can be read from the consumable memory 663 to be used to restore the status information in the management memory 630. It is preferable that the consumable memories 663, 672, 673, 682, 692 and 693 share an identical control signal and a data control signal.

When it is determined that the status information stored in the consumable memories 663, 672, 673, 682, 692 and 693 is valid, the central controller 650 outputs image information using the image forming unit 620. Meanwhile, the central controller 650 calculates the amount of consumables to use to form the image. Various conventional algorithms can be adopted to calculate the amount of consumable use.

For example, the remaining amount of toner in a color cartridge is read from the consumable memory to calculate the amount of consumable to use. Also, the amount of toner used during a printing operation is calculated. The amount of consumable used varies due to the resolution and size of the printed image. For example, an image printed with a resolution of 600 dpi consumes four times the amount of toner as consumed when the same image with a resolution of 300 dpi is printed. It is apparent that the amount of toner used during printing increases as the size of the image increases.

Then, the central controller 650 subtracts the calculated amount of consumable toner to be used from the previous value and transfers the result to the management memory 630 and the consumable memories 663, 672, 673, 682, 692 and 693.

Alternatively, the operation time of a motor can be used to calculate the amount of consumable used by the middle transferring belt 665 and the photosensitive drum 670. The motor rotates the photosensitive drum 670. Generally, the photosensitive drum 670 has a limited lifetime since some amount of used toner is not collected during the cleaning process after a transferring operation, and remains on the photosensitive drum 670. Therefore, the number of rotations can be used to estimate the remaining lifetime of the photosensitive drum 670. The number of rotations of the photosensitive drum 670 is calculated by using the operation time of the motor stored in the consumable memory 672.

As shown in FIG. 6, the image forming device 600 stores status information both in the consumable memories 663, 672, 673, 682, 692 and 693 and the management memory 630, so the status information can be managed safely.

The management memory 630 included in the image forming device 600 shown in FIG. 6 and the consumable memories 663, 672, 673, 682, 692 and 693 included in the consumables 600 preferably are Electrically Erasable and Programmable Read Only Memories (EPROM's).

Figure 7:
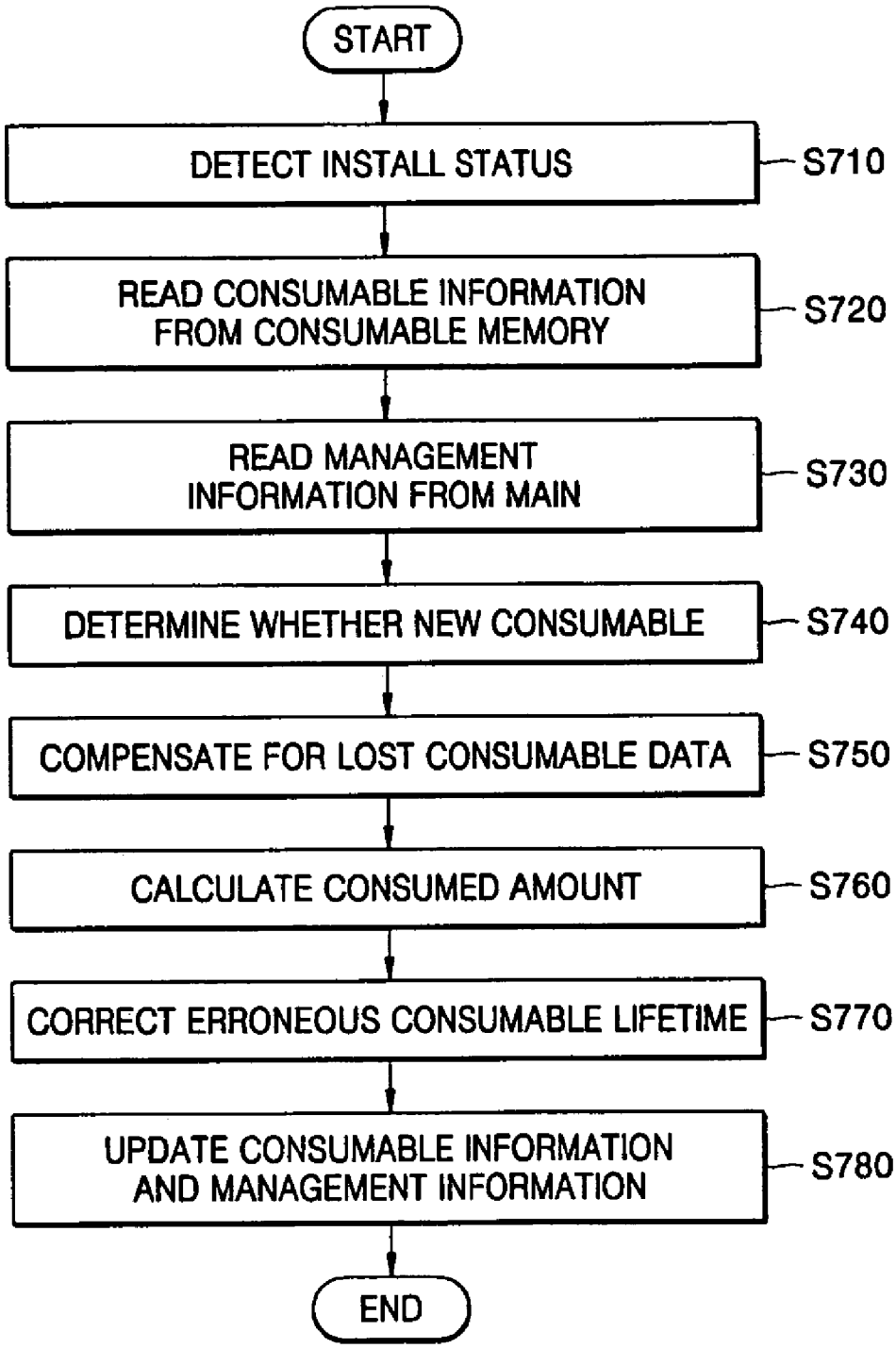
FIG. 7 is a flowchart of a consumable status management method according to an embodiment of the present invention.

FIG. 7 is a flowchart of an embodiment of a consumable status management method according to the present invention.

First, it is determined whether a consumable is securely installed in operation S710 so that a user can be informed of poorly installed consumables. Then, the image forming device reads consumable status information ('consumable information', hereinafter) including the remaining lifetime of the consumable from a consumable memory included in the consumable (S720). In the meantime, any erroneous consumable information can be identified when valid consumable information is not read.

When valid consumable status information is read, management information on the lifetime of the consumable is read from the main image forming device in operation S730. The management information is stored in the management memory 630 shown in FIG. 6 or main memory. Then, the image forming device determines whether the consumable is newly installed in operation S740. Various methods can be used in operation S740. For example, the consumable is determined to be newly installed when there is no management information related to the consumable in the image forming device. Alternatively, the consumable information can directly show that the consumable has not been used in the image forming device.

Then, whether the status information of the consumable is lost is determined in operation S750. As described above, the status information can be identified to be lost when the management information and the consumable information are not the same. The erroneous status information can be restored using valid information.

After restoration of the consumable information, the image forming device performs a printing operation. During the printing operation, an amount of consumable used is calculated in operation S760. As noted above, various conventional methods can be used for this calculation. Then, the remaining lifetime of the consumable is updated by using the calculated result, and errors can be corrected as follows.

For example, if the management information is not updated due to a sudden blackout or other causes during the updating the management information using the amount of consumable used that is stored in the management memory. In this case, the management information calculated in the image forming device is lost and the value of the remaining lifetime of the consumable is also lost. In embodiments of the present invention, however, this information can be simply restored by using the consumable information stored in the consumable memory.

Figure 8:
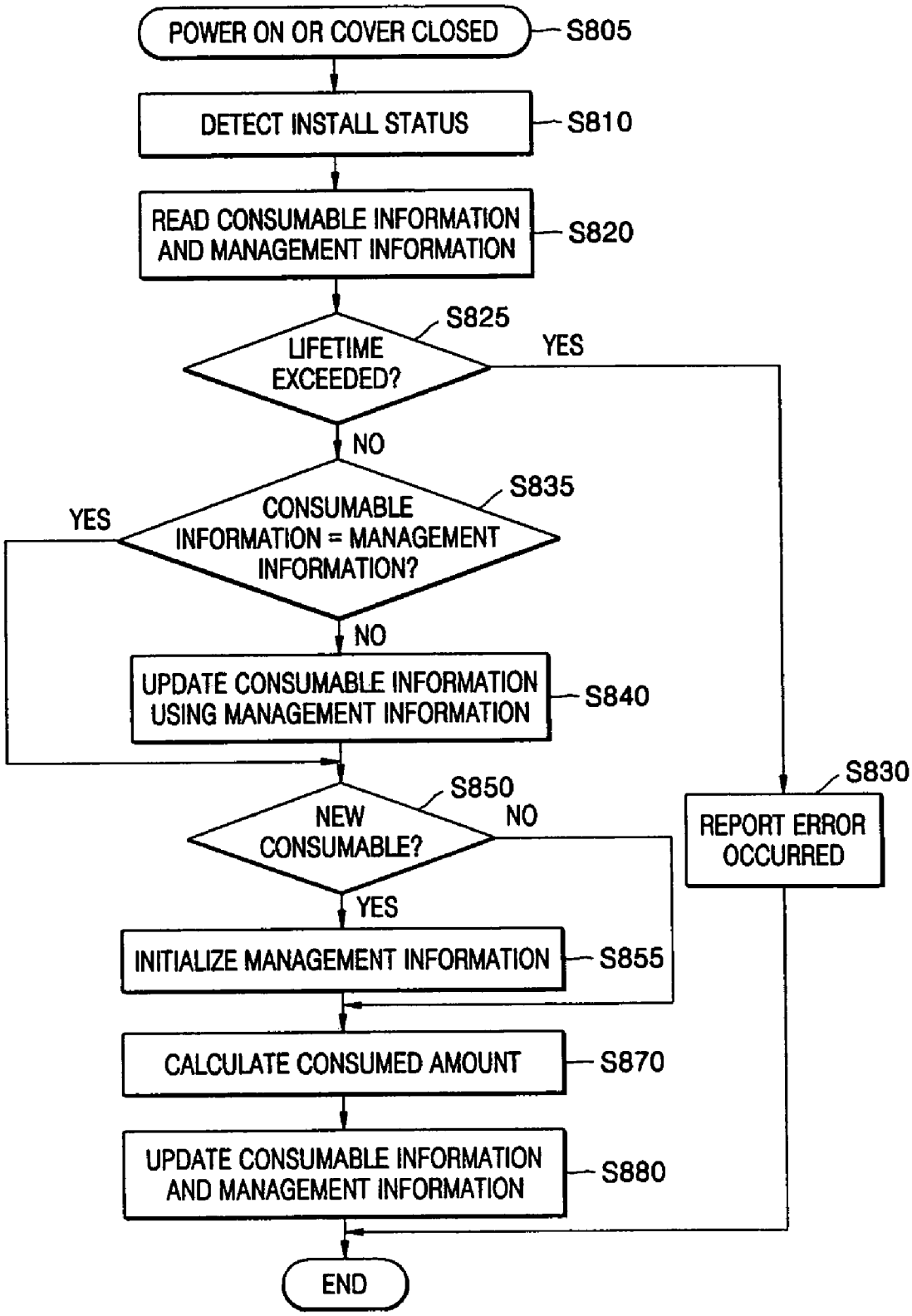
FIG. 8 is a flowchart of the method shown in FIG. 7 according to another embodiment of present invention.

FIG. 8 is a flowchart of another embodiment of the method shown in FIG. 7.

First, whether power is on, or a cover is closed is detected in operation S805. Then, whether a consumable is securely installed is determined in operation S810. An error message is presented to a user when the consumable is poorly installed. Otherwise, the method proceeds to the next operations.

Then, the consumable information and the management information are read from the consumable memory included in the consumable and the management memory included in the image forming device in operation S820. Whether the expected lifetime is exceeded is determined in operation S825. When the expected lifetime is determined to be exceeded, a user is informed so and the method is terminated. When the expected lifetime is determined not to be exceeded, whether the consumable information read from the consumable memory is identical to the management information read from the management memory is determined in operation S835. When they do not match, the consumable information is updated using the management information in operation S840. Since the consumable information can be updated, the status information of the consumable can be safely managed.

Then, whether the consumable is newly installed is determined in operation S850. When the consumable is newly installed, the management information stored in the management memory is initialized in operation S855. During a printing process, an amount of the consumable used is calculated by using various algorithms in operation S870. As a result, the consumable information and the management information are updated by using the calculated amount of consumable used in operation S880.

Although the method in FIG. 8 depicts an updating operation S840 by using only management information, embodiments of the present invention are not limited thereto. However, it is apparent that the management information can be updated by using the consumable information when the management memory malfunctions.

FIG. 9A and 9B illustrate status information of the consumable managed by the method according to the present invention.

FIG. 9A illustrates various management information stored in the management memory of the image forming device according to embodiments of the present invention. Each consumable information may include a manufacturer name, a model name, a production date, a serial number, an amount of remaining toner, and a printing dot count. In case of a Yellow cartridge, it can be known that the manufacturer is SAMSUNG electronics, the model name is COLOR100, the production date is Oct. 1, 2003, the serial number is Ser. No. 000001, and the remaining amount of toner is for printing 1000 sheets.

FIG. 9B illustrates consumable information included in each consumable. In particular, FIG. 9B shows consumable information stored in a consumable memory included in a Yellow cartridge. Therefore, the upper part of the table shown in FIG. 9A is managed and updated to be identical to the table in FIG. 9B.

The status information of consumables is stored in separate memories as shown in FIG. 9A and FIG. 9B.

The status information of the consumable included in the image forming device can be managed stably by using a management memory included in the image forming device and a consumable memory included in the consumable.

Additionally, an image forming device managing status information of consumables is reliably provided.

Furthermore, a consumable, which includes a consumable memory to store status information safely, is provided.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of managing a status of a consumable in an image forming device for transferring an electrostatic image formed on a surface of a photosensitive medium onto paper, the method comprising the steps of:

reading consumable information including remaining lifetime information from a consumable memory in the consumable;

reading management information related to the status of more than one consumable in the image forming device from a management memory in the image forming device;

calculating an amount of consumables used during an operation of the image forming device;

updating the consumable information and the management information based on the calculated amount of consumable used; and restoring the management information using the consumable information read from the consumable memory when the management information stored in the management memory is erased erroneously.

2. The method of claim 1, wherein the method further comprises:

comparing the read consumable information with the management information; and updating the consumable information using the management information when the consumable information and the management information are identical.

3. The method of claim 1, wherein the method further includes:

determining whether the consumable is newly installed in the image forming device by using the information about the manufacturer and the unique identifier; and initializing the management information and informing a user of the newly installed consumable when the consumable is determined to be a newly installed one, and wherein the consumable information and the management information further comprise information about a manufacturer of the consumable and a unique identifier of the consumable.

4. The method of claim 1, wherein the method further comprises:

analyzing the consumable information read from the consumable memory, and informing the user that the consumable is not installed safely when the commodity information is determined not to be valid.

5. The method of claim 1, wherein the consumable comprises either a middle transferring belt for transferring the electrostatic image or a photosensitive drum on which the electrostatic image is formed, and the calculating of the amount of the consumable used is performed by using an operation time of the middle transferring belt and a number of rotations of the photosensitive drum.

6. The method of claim 1, wherein the consumable comprises a toner cartridge containing toner of a predetermined color, and the calculating of the amount of consumable used is performed by using a printing mode, and a printing resolution.

7. An image forming device having more than one consumable and transferring an electrostatic image formed on a surface of a photosensitive medium onto paper, the device comprising:

an image forming unit for printing a predetermined image in response to a control signal from a central controller; and a management memory for storing management information related to status information of the consumables, and wherein the central controller:

reads the consumable information comprising a remaining lifetime of the consumable from a consumable memory in the consumable;

reads the management information from the management memory in the image forming device;

calculates an amount of the consumable used during an operation of the image forming device;

updates the consumable information and the management information using the calculated amount of consumable used; and restores the management information using the consumable information read from the consumable memory when the management information stored in the management memory is erased erroneously.

8. The device of claim 7, wherein the central controller further:

compares the read consumable information with the management information; and updates the consumable information using the management information when the consumable information and the management information are identical.

9. The device of claim 7, wherein the consumable information and the management information further include information about a manufacturer of the consumable and a unique identifier of the consumable, and wherein the central controller further determines whether the consumable is newly installed in the image forming device by using the information about the manufacturer and the unique identifier; and initializes the management information and informs a user of the newly installed consumable when the consumable is determined to be a newly installed one.

10. The device of claim 7, wherein the central controller analyzes the consumable information read from the consumable memory, and informs the user that the consumable is not installed safely when the commodity information is determined not to be valid.

11. The device of claim 7, wherein the consumable comprises either a middle transferring belt for transferring the electrostatic image or a photosensitive drum on which the electrostatic image is formed, and the central controller uses an operation time of the middle transferring belt and a number of rotations of the photosensitive drum to calculate the amount of use of the consumable.

12. The device of claim 7, wherein the consumable comprises a toner cartridge containing toner of a predetermined color, and the central controller uses more than one of a printing atmosphere, a printing mode, and a printing resolution to calculate the amount of use of the consumable.

13. A consumable used in an image forming device, the consumable comprising a memory for storing consumable information related to a remaining lifetime of the consumable and providing the consumable information to the image forming device in response to a signal of the image forming device, wherein the memory updates the consumable information as the consumable is being used in response to a control signal of the image forming device; and wherein the consumable is coupled to a controller for restoring management information using the consumable information read from the memory when the management information stored in a management memory is erased erroneously.

14. The consumable of claim 13, wherein the consumable information further comprises information about a manufacturer of the consumable and a unique identifier of the consumable.

15. The consumable of claim 13, wherein the consumable comprises either a middle transferring belt for transferring an electrostatic image or a photosensitive drum on which the electrostatic image is formed.

16. The consumable of claim 13, wherein the consumable comprises a toner cartridge containing toner of a predetermined color.

* * * * *